US006011937A

United States Patent [19]

Chaussade et al.

[11] Patent Number: 6,011,937

[45] Date of Patent: Jan. 4, 2000

[54] ASSEMBLY OF A PRINTER AND ITS CONSUMPTION TANK FOR BUSINESS MACHINE

[75] Inventors: Xavier Chaussade, Herblay; Michel Brot, Argenteuil, both of France

[73] Assignee: Sagem SA, France

[21] Appl. No.: 08/874,895

[22] Filed: Jun. 13, 1997

[30] Foreign Application Priority Data

Jun. 13, 1996 [FR] France ..... 96 07354

[51] Int. Cl.[7] ..... G03G 15/00

[52] U.S. Cl. ..... 399/24; 399/25; 399/27

[58] Field of Search ..... 399/24, 25, 27, 399/29, 12, 13, 11, 8; 347/7, 19, 86, 87

[56] References Cited

U.S. PATENT DOCUMENTS

| | | | |
|---|---|---|---|
| Re. 35,751 | 3/1998 | Midgley | 399/25 |
| 4,961,088 | 10/1990 | Gilliland et al. | 399/25 |
| 4,994,853 | 2/1991 | Fukuchi et al. | 399/12 |
| 5,077,581 | 12/1991 | Suzuki | 399/11 |
| 5,272,503 | 12/1993 | LeSueur et al. | 399/25 |
| 5,283,613 | 2/1994 | Midgley, Sr. . | |
| 5,365,312 | 11/1994 | Hillmann et al. | 399/12 |
| 5,489,971 | 2/1996 | Nam | 399/12 |
| 5,491,540 | 2/1996 | Hirst | 399/12 |
| 5,572,292 | 11/1996 | Chatani et al. | 399/25 |
| 5,699,091 | 12/1997 | Bullock et al. | 399/24 X |
| 5,835,817 | 11/1998 | Bullock et al. | 399/25 |

FOREIGN PATENT DOCUMENTS

| | | |
|---|---|---|
| 0393627 | 10/1990 | European Pat. Off. . |
| 93/12473 | 6/1993 | WIPO . |

OTHER PUBLICATIONS

Patent Abstract of Japan–vol. 13,No. 4 (P–809), Sep. 1, 1989, A 6321956 (Bando Chem. Ind. Ltd.), May 1988.

*Primary Examiner*—Matthew S. Smith
*Attorney, Agent, or Firm*—Quarles & Brady

[57] ABSTRACT

The system for a printer in its reservoir for consumables for office equipment includes essential command unit for a printer, an electric chip having a balance of consumables and memory and a device to control the reservoir of consumables. The device includes a chip/central unit interfaced in a computer intended to determine the content of the reservoir of consumables, by calculating the flow, in cooperation with the central unit, by estimating the quantity of consumables used according to the estimated quantity of printed copies, and the balance of consumables left. This system has applications to photocopiers as well.

4 Claims, 1 Drawing Sheet

ASSEMBLY OF A PRINTER AND ITS CONSUMPTION TANK FOR BUSINESS MACHINE

The invention concerns a printer for office equipment such as a fax machine, a photocopier or a computer, for example, which may use thermal transfer, ink jet or laser for printing, with consumables such as printer ribbon, ink or toner.

The consumables used for printing are contained in a reservoir, (roll, cartridge), intended to be inserted in a receptacle housing located inside the printer.

Generally, when the reservoir of consumables placed inside the printer is empty or almost empty, a control light turns on by means of a printer-user interface, to inform the user that the reservoir should be replaced.

Therefore such control device does not allow to prepare for a subsequent need for consumables, and the user can be taken by surprise and be short of consumables in reserve.

We know, from the U.S. Pat. No. 5,283,613, of a system for a printer and its reservoir for consumables for office equipment, with a central command unit and a control system for the content of the reservoir of consumables combined with a storage system where the balance of consumables remaining is kept in memory. The control system includes a central unit/storage system interface combined with a management system including the means to determine the content of the reservoir of consumables.

The balance of consumables, corresponding with the printing capacity of the reservoir, is represented by a number of images rang to print and decreased by the number of images successively printed.

Such an estimate of consumables used according to the number of images printed is very approximate and results in a calculation for the balance of consumables remaining that is not very reliable.

The invention aims to compensate for this drawback.

For that purpose, the invention concerns a system such as the type defined below, characterized by the fact that the management system includes, in cooperation with the central unit, a system to calculate the flow and estimate die consumables used according to an estimated quantity of copies, and a system to calculate the balance of consumables remaining.

With this invention, the user can find out anytime and with reliability the amount of consumables contained in the reservoir, since the calculation for the consumables flowing is in proportion with the consumables used and precisely estimated during printing.

The other advantage is that the storage system can authenticate the consumables.

In a preferred manner of implementation of this invention, the storage system includes an electronic chip and the central unit/chip interface includes connectors to connect the chip to the central unit.

In this manner, the calculation of consumables available to the user is accomplished on a support.

Again, it is preferred that the chip be installed on a detachable card mounted to the reservoir of consumables that can be inserted in a receptacle system in the printer.

Here, the receptacle system may include a support plate for sliding the card in relation to a frame fixed and interdependent with the printer supporting the connectors, or may also include a slot to receive the chip card, with the connectors on one of its internal sides, with the chip sliding in to make the connection.

In a variant of the invention, the chip is permanently mounted on the reservoir for consumables, and the connectors are mounted on the internal side of a cover of a receptacle housing for the reservoir of consumables.

The chip can also be used as a locking/unlocking key for the printer to authorize or not authorize its operation.

Finally, the storage system and the central unit-chip interface may respectively include an electronic chip and a device intended to connect the chip to the central unit through a connection without contact.

To better understand the invention, the description of three ways to carry out the system for the printer and reservoir for consumables for office equipment is given below, and can be referred to in the appended drawing on which:

Figure 1:
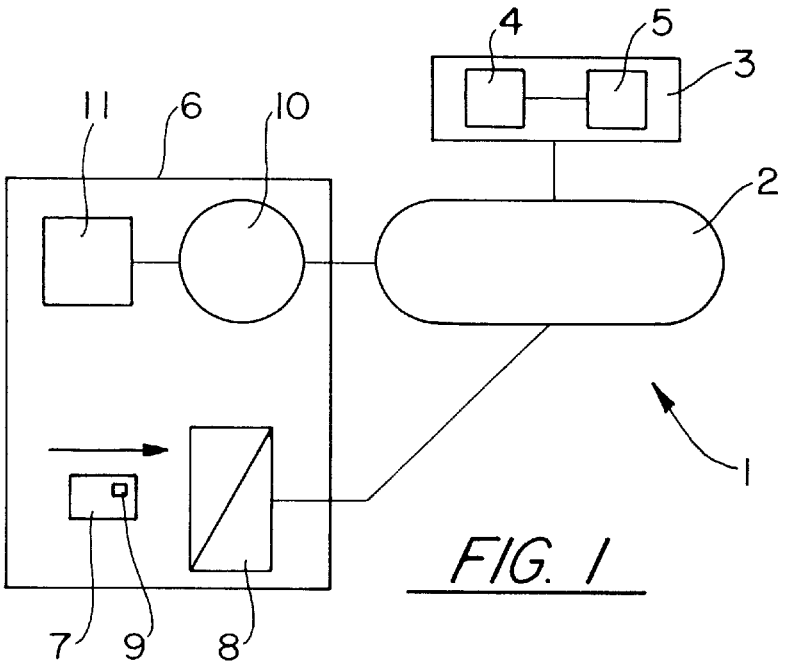
FIG. 1 represents a functional block diagram with the first type of embodiment of the system.
Figure 2:
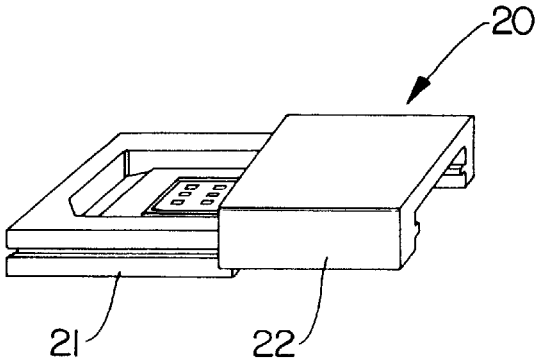
FIG. 2 represents the receptacle system for a chip card for the system in FIG. 1.
Figure 3:
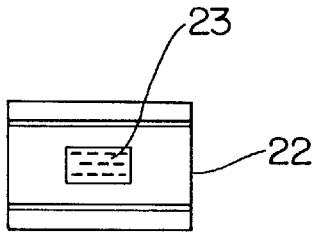
FIG. 3 represents a bottom view of part of FIG. 2.
Figure 4:
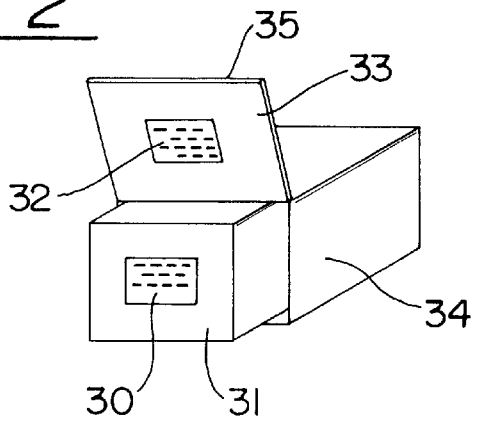
FIG. 4 represents the receptacle system for a chip card for the third type of embodiment of the system.

The laser printer 1, for office equipment, here a photocopier, includes a central command unit 2, in this instance a microprocessor, connected to a printing unit including a printing device 4 on a printing support for paper, for example, and a reservoir for consumables 5, in this instance a reservoir of toner for laser printing intended to supply the printing device 4 with toner.

The reservoir 5 is connected with a storage system including an electronic memory chip 9 supported here by a telephone card 7, but that could be of another type of format. The consumables card 7 is mounted and is detachable from the reservoir 5 as commercially found, and is inserted in the printer 1. The chip 9 contains the balance of consumables remaining in memory, in other words a number of units of consumables contained in the reservoir 5, a unit corresponding to a number of dots of ink to print, and also the consumables authentication data to reject the card in case of inadequate consumables.

In the printer 1, the central unit 2 is also connected to a device 6 to control the reservoir of consumables 5. This control device includes:

- a read and write interface 8 connected on one side to the microprocessor 2, and can be connected on the other side to the chip 8 with the connectors 23,
- a computer 10 to calculate the flow and balance of consumables left, and
- a display screen 11 of a printer/user interface, connected to the computer 10,
- the interface 8 and the computer 10 are both connected to the central unit 2.

The interface 8 for the microprocessor/chip 2/9 includes a device 20 to receive the chip card 7 with a card support plate 21 that can slide between an opening position outside the printer and a closed position inside the printer, in relation to a frame 22 supporting the connectors 23, fixed and interdependent with the printer. In the closed position the front of the plate 21 intended to support the consumables card 7 faces the front of the frame 22 supporting the connectors 23.

Once the chip card 7 is detached from a new full reservoir 5, the user can insert the reservoir 5 into its receptacle housing inside the printer 1, and place the card 7 for the consumables on the open support plate 21 before closing it by sliding it into the printer. While sliding, the chip 9 will position itself on the connectors 23 of the frame 22, to make the connection to the chip/microprocessor 9/2.

Every time a piece of paper is printing, the reservoir 5 supplies the printing device 4 with consumables. The computer 10 esimates the usage of consumables from this printing by determining a number of units of consumables to flow according to an approximate number of dots of ink printed.

In addition, the microprocessor 2 reads from the chip 9, using the interface 8, the amount from the previous balance of consumables, and then sends the information to the computer 10.

According to the number of units of consumables to flow D and the previous balance amount S, and the number So of units of consumables corresponding to the fill content of the reservoir, the computer 10 calculates, for example, the filling rate T of the reservoir of consumables equal to:

$$T = \frac{S - D}{So}$$

The estimated filling rate corresponds to the quantity of consumables left to be used in the reservoir 5.

With the second type of system, the chip card 7 is installed inside a receptacle slot designed in the printer, the connectors 23 are mounted on one of the internal sides of the slot in such a way that the chip 9 connects by sliding it in during insertion into the slot.

In a third type of embodiment for the system, the chip 30 is permanently fixed on the reservoir of consumables 31, using a clamping support, and the connectors 32 that connect the chip to the microprocessor are mounted on the internal side 33 of a cover 35 for the receptacle housing 34 of the reservoir 31. We could also consider a chip mounted directly on the reservoir, without a clamping support in between.

The chip card format shown in the description below is the telephonic type, but it could very well be an SIM card, or other type.

In a variant of the invention, the insertion of the chip card of consumables in the printer authorizes the printer to operate, the card acts as a key for locking and unlocking.

In the description that precedes, the connection between the chip and the printer is accomplished through contact with the use of connectors intended to come in contact with the chip, we could also consider such a connection to be made without contact, through electromagnetic connection, with the use of a connecting device without contact.

The printer that has just been described is a laser printer.

The invention could also be applied to any other printing technique, especially with ink jet printing. Here, the calculation of the number of units of consumables used can be estimated by counting the number of ink droplets used and the number of ink droplets left to be used.

Finally, in the case of a color printer intended to print in colors by using several color consumables, the printer could include a computer adjusted to estimate the usage of the respective consumables, and the respective quantities of consumables left.

We claim:

1. A printer system for monitoring the content of a consumable in a reservoir of a printer, comprising:

a central command unit;

a storage system;

an electronic chip supported on a card, said electronic chip having a memory of the balance of consumable in said reservoir, said card detachable from said reservoir for insertion into a receptacle of said printer;

at least one electrical connector for providing communication between said central command unit and said storage system; and a management system communicating with said at least one electrical connector, said management system including a means for determining the content of the reservoir of consumables, wherein said management system calculates the flow and estimates the quantity of consumables used, based on an estimate of the quantity of copies printed, to calculate the quantity of consumables remaining in said reservoir.

2. A printer system for monitoring the content of a consumable in a reservoir of a printer, comprising:

a central command unit;

a storage system;

an electronic chip supported on a card, said electronic chip having a memory of the balance of consumable in said reservoir, said card detachable from said reservoir for insertion into a receptacle of said printer, said receptacle including a plate slidably mounted in a frame;

at least one connector formed in said frame for providing communication between said central command unit and said storage system; and a management system communicating with said interface, said management system including a means for determining the content of the reservoir of consumables, wherein said management system calculates the flow and estimates the quantity of consumables used, based on an estimate of the quantity of copies printed, to calculate the quantity of consumables remaining in said reservoir.

3. A printer system for monitoring the content of a consumable in a reservoir of a printer, comprising:

a central command unit;

an electronic chip supported on a card, said electronic chip having a memory of the balance of consumable in said reservoir, said card detachable from said reservoir for insertion into a slot of said printer;

at least one connector mounted on an internal side of said slot for communicating with said card; and a management system communicating with said interface, said management system including a means for determining the content of the reservoir of consumables, wherein said management system calculates the flow and estimates the quantity of consumables used, based on an estimate of the quantity of copies printed, to calculate the quantity of consumables remaining in said reservoir.

4. A printer system for monitoring the content of a consumable in a reservoir, comprising:

a central command unit;

a storage system;

an electronic chip having a memory of the balance of consumable in said reservoir, said chip fixedly attached to said reservoir of consumables;

a receptacle housing for receiving said reservoir, said housing having a cover, at least one electrical connector for providing communication between said central command unit and said storage system, said connector mounted on an internal side of said receptacle housing cover; and a management system communicating with said interface, said management system including a means for determining the content of the reservoir of consumables, wherein said management system calculates the flow and estimates the quantity of consumables used, based on an estimate of the quantity of copies printed, to calculate the quantity of consumables remaining in said reservoir.

* * * * *